US008074339B1

(12) United States Patent
Brandt et al.

(10) Patent No.: US 8,074,339 B1
(45) Date of Patent: Dec. 13, 2011

(54) METHODS OF MANUFACTURING A LATTICE HAVING A DISTRESSED APPEARANCE

(75) Inventors: Jeffrey R. Brandt, Millersport, OH (US); Matthew F. Kollar, Powell, OH (US); Burch E. Zehner, Gahanna, OH (US); Bryan K. Buhrts, Wilmington, DE (US); William G. Taylor, Columbus, OH (US)

(73) Assignee: The Crane Group Companies Limited, Columbus, OH (US)

( * ) Notice: Subject to any disclaimer, the term of this patent is extended or adjusted under 35 U.S.C. 154(b) by 871 days.

(21) Appl. No.: 11/968,086

(22) Filed: Dec. 31, 2007

Related U.S. Application Data

(63) Continuation-in-part of application No. 10/995,086, filed on Nov. 22, 2004, now abandoned.

(51) Int. Cl.
*B21D 39/00* (2006.01)
*E04C 2/42* (2006.01)

(52) U.S. Cl. ..... 29/527.1; 52/342; 52/664

(58) Field of Classification Search ..... 29/527.1; 52/342, 660, 664
See application file for complete search history.

(56) References Cited

U.S. PATENT DOCUMENTS

| | | | |
|---|---|---|---|
| 2,072,687 | A | 3/1937 | Robinson |
| 2,153,316 | A | 4/1939 | Sherrard et al. |
| 2,156,160 | A | 4/1939 | Olson et al. |
| 2,188,396 | A | 1/1940 | Semon |
| 2,306,274 | A | 12/1942 | Meiler |
| 2,316,283 | A | 4/1943 | Piperoux et al. |
| 2,451,558 | A | 10/1948 | Schlosser |
| 2,489,373 | A | 11/1949 | Gilman |
| 2,519,442 | A | 8/1950 | Delorme et al. |
| 2,535,373 | A | 12/1950 | Shearer et al. |
| 2,558,378 | A | 6/1951 | Petry |
| 2,634,534 | A | 4/1953 | Brown |
| 2,635,976 | A | 4/1953 | Meiler et al. |
| 2,680,102 | A | 6/1954 | Becher |
| 2,759,837 | A | 8/1956 | Roberts |
| 2,789,903 | A | 4/1957 | Lukman et al. |
| 2,935,763 | A | 5/1960 | Newman et al. |
| 2,976,164 | A | 3/1961 | Glab |
| 3,287,480 | A | 11/1966 | Wechsler et al. |
| 3,308,218 | A | 3/1967 | Wiegand et al. |
| 3,309,444 | A | 3/1967 | Schueler |
| 3,492,388 | A | 1/1970 | Inglin-Knuse |

(Continued)

FOREIGN PATENT DOCUMENTS

CA 2153659 A1 2/1999

(Continued)

OTHER PUBLICATIONS

Edward G. Hoffman, "Production methods", in AccessScience@McGraw-Hill, http://www.accessscience.com, DOI 10.1036/1097-8542.547200, last modified: Aug. 15, 2002.*

(Continued)

*Primary Examiner* — Jermie Cozart
(74) *Attorney, Agent, or Firm* — Standley Law Group LLP

(57) ABSTRACT

Methods of manufacturing a composite lattice structure made of cellulosic, inorganic, and/or polymer materials are disclosed. The unique lattice is weather-resistant and low-maintenance and may be used for ornamental gardening trellises, overhead outdoor patio or deck coverings, window lattices, privacy fences, garden fences, ornamental skirting or façades such as around the bottom of an elevated deck or porch, and other suitable functions.

11 Claims, 4 Drawing Sheets

U.S. PATENT DOCUMENTS

| | | | | |
|---|---|---|---|---|
| 3,493,527 | A | | 2/1970 | Schueler |
| 3,533,906 | A | | 10/1970 | Reiniger |
| 3,562,373 | A | | 2/1971 | Logrippo |
| 3,645,939 | A | | 2/1972 | Gaylord |
| 3,671,615 | A | | 6/1972 | Price |
| 3,769,380 | A | | 10/1973 | Wiley |
| 3,852,387 | A | | 12/1974 | Bortnick et al. |
| 3,864,201 | A | | 2/1975 | Susuki et al. |
| 3,867,493 | A | | 2/1975 | Seki |
| 3,878,143 | A | | 4/1975 | Baumann et al. |
| 3,879,505 | A | | 4/1975 | Boutillier et al. |
| 3,888,810 | A | | 6/1975 | Shinomura |
| 3,899,559 | A | | 8/1975 | Johnanson et al. |
| 3,908,902 | A | | 9/1975 | Collins et al. |
| 3,922,328 | A | | 11/1975 | Johnson |
| 3,931,384 | A | | 1/1976 | Forquer et al. |
| 3,943,079 | A | | 3/1976 | Hamed |
| 3,954,555 | A | | 5/1976 | Kole et al. |
| 3,956,541 | A | | 5/1976 | Pringle |
| 3,956,555 | A | | 5/1976 | McKean |
| 3,969,459 | A | | 7/1976 | Fremont et al. |
| 4,005,035 | A | | 1/1977 | Deaver |
| 4,005,162 | A | | 1/1977 | Bucking |
| 4,012,348 | A | | 3/1977 | Chelland et al. |
| 4,016,232 | A | | 4/1977 | Pringle |
| 4,016,233 | A | | 4/1977 | Pringle |
| 4,018,722 | A | | 4/1977 | Baker |
| 4,029,831 | A | | 6/1977 | Daunheimer |
| 4,045,603 | A | | 8/1977 | Smith |
| 4,048,101 | A | | 9/1977 | Nakamachi et al. |
| 4,056,591 | A | | 11/1977 | Goettler et al. |
| 4,058,580 | A | | 11/1977 | Flanders |
| 4,071,479 | A | | 1/1978 | Broyde et al. |
| 4,071,494 | A | | 1/1978 | Gaylord |
| 4,081,582 | A | | 3/1978 | Butterworth et al. |
| 4,091,153 | A | | 5/1978 | Holman |
| 4,097,648 | A | | 6/1978 | Pringle |
| 4,101,050 | A | | 7/1978 | Buckler et al. |
| 4,102,106 | A | | 7/1978 | Golder et al. |
| 4,107,110 | A | | 8/1978 | Lachowicz et al. |
| 4,115,497 | A | | 9/1978 | Halmo et al. |
| 4,129,132 | A | | 12/1978 | Butterworth et al. |
| 4,133,930 | A | | 1/1979 | Wright et al. |
| 4,145,389 | A | | 3/1979 | Smith |
| 4,157,415 | A | | 6/1979 | Lindenberg |
| 4,168,251 | A | | 9/1979 | Schinzel et al. |
| 4,178,411 | A | | 12/1979 | Cole et al. |
| 4,181,764 | A | | 1/1980 | Totten |
| 4,187,352 | A | | 2/1980 | Klobbie |
| 4,191,798 | A | | 3/1980 | Schumacher et al. |
| 4,192,839 | A | | 3/1980 | Hayashi et al. |
| 4,198,363 | A | | 4/1980 | Noel |
| 4,203,876 | A | | 5/1980 | Dereppe et al. |
| 4,228,116 | A | | 10/1980 | Colombo et al. |
| 4,239,679 | A | | 12/1980 | Rolls et al. |
| 4,241,125 | A | | 12/1980 | Canning et al. |
| 4,241,133 | A | | 12/1980 | Lund et al. |
| 4,244,903 | A | | 1/1981 | Schnause |
| 4,248,743 | A | | 2/1981 | Goettler |
| 4,248,820 | A | | 2/1981 | Haataja |
| 4,250,222 | A | | 2/1981 | Mavel et al. |
| 4,263,184 | A | | 4/1981 | Leo et al. |
| 4,263,196 | A | | 4/1981 | Schumacher et al. |
| 4,272,577 | A | | 6/1981 | Lyng |
| 4,273,688 | A | | 6/1981 | Porzel et al. |
| 4,277,428 | A | | 7/1981 | Luck et al. |
| 4,290,988 | A | | 9/1981 | Nopper et al. |
| 4,297,408 | A | | 10/1981 | Stead et al. |
| 4,303,019 | A | | 12/1981 | Haataja et al. |
| 4,305,901 | A | | 12/1981 | Prince et al. |
| 4,317,765 | A | | 3/1982 | Gaylord |
| 4,323,625 | A | | 4/1982 | Coran et al. |
| 4,337,963 | A | * | 7/1982 | Stevenson ..... 280/87.042 |
| 4,351,873 | A | | 9/1982 | Davis |
| 4,376,144 | A | | 3/1983 | Goettler |
| 4,382,108 | A | | 5/1983 | Carroll et al. |
| 4,382,758 | A | | 5/1983 | Nopper et al. |
| 4,393,020 | A | | 7/1983 | Li et al. |
| 4,414,267 | A | | 11/1983 | Coran et al. |
| 4,420,351 | A | | 12/1983 | Lussi et al. |
| 4,430,468 | A | | 2/1984 | Schumacher |
| 4,440,708 | A | | 4/1984 | Haataja et al. |
| 4,480,061 | A | | 10/1984 | Coughlin et al. |
| 4,481,701 | A | | 11/1984 | Hewitt |
| 4,491,553 | A | | 1/1985 | Yamada et al. |
| 4,503,115 | A | | 3/1985 | Hemels et al. |
| 4,505,869 | A | | 3/1985 | Nishibori |
| 4,506,037 | A | | 3/1985 | Suzuki et al. |
| 4,508,595 | A | | 4/1985 | Gasland |
| 4,518,552 | A | | 5/1985 | Matsuo et al. |
| 4,562,218 | A | | 12/1985 | Fornadel et al. |
| 4,594,372 | A | | 6/1986 | Natov et al. |
| 4,597,928 | A | | 7/1986 | Terentiev et al. |
| 4,610,900 | A | | 9/1986 | Nishibori |
| 4,645,631 | A | | 2/1987 | Hegenstaller et al. |
| 4,659,754 | A | | 4/1987 | Edwards et al. |
| 4,663,225 | A | | 5/1987 | Farley et al. |
| 4,686,251 | A | | 8/1987 | Ostermann et al. |
| 4,687,793 | A | | 8/1987 | Motegi et al. |
| 4,708,623 | A | | 11/1987 | Aoki et al. |
| 4,717,742 | A | | 1/1988 | Beshay |
| 4,734,236 | A | | 3/1988 | Davis |
| 4,737,532 | A | | 4/1988 | Fujita et al. |
| 4,744,930 | A | | 5/1988 | Twist et al. |
| 4,746,688 | A | | 5/1988 | Bistak et al. |
| 4,769,109 | A | | 9/1988 | Tellvik et al. |
| 4,769,274 | A | | 9/1988 | Tellvik et al. |
| 4,783,493 | A | | 11/1988 | Motegi et al. |
| 4,789,604 | A | | 12/1988 | van der Hoeven |
| 4,790,966 | A | | 12/1988 | Sandberg et al. |
| 4,791,020 | A | | 12/1988 | Kokta |
| 4,800,214 | A | | 1/1989 | Waki et al. |
| 4,801,495 | A | | 1/1989 | van der Hoeven |
| 4,818,590 | A | | 4/1989 | Prince et al. |
| 4,818,604 | A | | 4/1989 | Tock |
| 4,820,749 | A | | 4/1989 | Beshay |
| 4,833,194 | A | | 5/1989 | Kuan et al. |
| 4,844,766 | A | | 7/1989 | Held |
| 4,851,458 | A | | 7/1989 | Hopperdietzel |
| 4,865,788 | A | | 9/1989 | Davis |
| 4,889,673 | A | | 12/1989 | Takimoto |
| 4,894,192 | A | | 1/1990 | Warych |
| 4,915,764 | A | | 4/1990 | Miani |
| 4,927,572 | A | | 5/1990 | van der Hoeven |
| 4,927,579 | A | | 5/1990 | Moore |
| 4,935,182 | A | | 6/1990 | Ehner et al. |
| 4,960,548 | A | | 10/1990 | Ikeda et al. |
| 4,968,463 | A | | 11/1990 | Levasseur |
| 4,973,440 | A | | 11/1990 | Tamura et al. |
| 4,978,489 | A | | 12/1990 | Radvan et al. |
| 4,988,478 | A | | 1/1991 | Held |
| 5,002,713 | A | | 3/1991 | Palardy et al. |
| 5,008,310 | A | | 4/1991 | Beshay |
| 5,009,586 | A | | 4/1991 | Pallmann |
| 5,049,334 | A | | 9/1991 | Bach |
| 5,055,247 | A | | 10/1991 | Ueda et al. |
| 5,057,167 | A | | 10/1991 | Gersbeck |
| 5,064,592 | A | | 11/1991 | Ueda et al. |
| 5,075,057 | A | | 12/1991 | Hoedl |
| 5,075,359 | A | | 12/1991 | Castagna et al. |
| 5,078,937 | A | | 1/1992 | Eela |
| 5,082,605 | A | | 1/1992 | Brooks et al. |
| 5,087,400 | A | | 2/1992 | Theuveny |
| 5,088,910 | A | | 2/1992 | Goforth et al. |
| 5,091,436 | A | | 2/1992 | Frisch et al. |
| 5,096,046 | A | | 3/1992 | Goforth et al. |
| 5,096,406 | A | | 3/1992 | Brooks et al. |
| 5,110,663 | A | | 5/1992 | Nishiyama et al. |
| 5,110,843 | A | | 5/1992 | Bries et al. |
| 5,120,776 | A | | 6/1992 | Raj et al. |
| 5,145,891 | A | | 9/1992 | Yasukawa et al. |
| 5,151,238 | A | | 9/1992 | Earl et al. |
| 5,153,241 | A | | 10/1992 | Beshay |
| 5,160,784 | A | | 11/1992 | Shmidt et al. |
| 5,165,941 | A | | 11/1992 | Hawley |
| 5,194,461 | A | | 3/1993 | Bergquist et al. |
| 5,218,807 | A | | 6/1993 | Fulford |

5,219,634 A 6/1993 Aufderhaar
5,234,652 A 8/1993 Woodhams et al.
5,258,232 A 11/1993 Summers et al.
5,272,000 A 12/1993 Chenoweth et al.
5,276,082 A 1/1994 Forry et al.
5,284,710 A 2/1994 Hartley et al.
5,288,772 A 2/1994 Hon
5,302,634 A 4/1994 Mushovic
5,356,697 A 10/1994 Jonas
5,369,147 A 11/1994 Mushovic
5,387,381 A 2/1995 Saloom
5,393,536 A 2/1995 Brandt et al.
5,406,768 A 4/1995 Giuseppe et al.
5,413,745 A 5/1995 Andersson
5,422,170 A 6/1995 Iwata et al.
5,423,933 A 6/1995 Horian
5,435,954 A 7/1995 Wold
5,441,801 A 8/1995 Deaner et al.
5,443,887 A 8/1995 Nakao
5,458,834 A 10/1995 Faber et al.
5,474,722 A 12/1995 Woodhams
D366,532 S 1/1996 Herbst et al.
5,480,602 A 1/1996 Nagaich
5,486,553 A 1/1996 Deaner et al.
5,497,594 A 3/1996 Giuseppe et al.
5,505,900 A 4/1996 Suwanda et al.
5,516,472 A 5/1996 Laver
5,518,677 A 5/1996 Deaner et al.
5,532,065 A 7/1996 Gubitz et al.
5,537,789 A 7/1996 Minke et al.
5,538,777 A 7/1996 Pauley et al.
5,539,027 A 7/1996 Deaner et al.
5,555,692 A 9/1996 Griffith
D374,485 S 10/1996 Brown
5,574,094 A 11/1996 Malucelli et al.
5,576,374 A 11/1996 Betso et al.
5,585,155 A 12/1996 Heikkila et al.
5,593,625 A 1/1997 Riebel et al.
5,624,616 A 4/1997 Brooks
5,695,874 A 12/1997 Deaner et al.
5,711,349 A 1/1998 Wissmann
5,725,939 A 3/1998 Nishibori
5,735,092 A 4/1998 Clayton et al.
5,744,210 A 4/1998 Hofmann et al.
5,759,680 A 6/1998 Brooks et al.
5,773,138 A 6/1998 Seethamraju et al.
5,776,841 A 7/1998 Bondoc et al.
5,783,125 A 7/1998 Bastone et al.
5,795,641 A 8/1998 Pauley et al.
5,807,514 A 9/1998 Grinshpun et al.
5,827,462 A 10/1998 Brandt et al.
5,827,607 A 10/1998 Deaner et al.
5,836,128 A 11/1998 Groh et al.
D402,381 S 12/1998 Gruda et al.
5,847,016 A 12/1998 Cope
5,851,469 A 12/1998 Muller et al.
5,858,522 A 1/1999 Turk et al.
5,863,064 A 1/1999 Rheinlander et al.
5,863,480 A 1/1999 Suwanda
5,866,054 A 2/1999 Dorchester et al.
5,866,264 A 2/1999 Zehner et al.
5,869,138 A 2/1999 Nishibori
5,869,176 A 2/1999 Dorchester et al.
5,882,564 A 3/1999 Puppin
5,910,358 A 6/1999 Thoen et al.
5,932,334 A 8/1999 Deaner et al.
5,948,505 A 9/1999 Puppin
5,948,524 A 9/1999 Seethamraju et al.
5,951,927 A 9/1999 Cope
5,965,075 A 10/1999 Pauley et al.
5,981,067 A 11/1999 Seethamraju et al.
5,985,429 A 11/1999 Plummer et al.
6,004,652 A 12/1999 Clark
6,004,668 A 12/1999 Deaner et al.
6,007,656 A 12/1999 Heikkila et al.
6,011,091 A 1/2000 Zehner
6,015,611 A 1/2000 Deaner et al.
6,015,612 A 1/2000 Deaner et al.
6,035,588 A 3/2000 Zehner et al.
D423,687 S 4/2000 Cantley
6,044,604 A 4/2000 Clayton et al.
6,054,207 A 4/2000 Finley
6,066,367 A 5/2000 Nishibori
6,066,680 A 5/2000 Cope
6,083,601 A 7/2000 Prince et al.
6,103,791 A 8/2000 Zehner
6,106,944 A 8/2000 Heikkila et al.
6,114,008 A 9/2000 Eby et al.
6,117,924 A 9/2000 Brandt
6,122,877 A 9/2000 Hendrickson et al.
6,131,355 A 10/2000 Groh et al.
6,133,348 A 10/2000 Kolla et al.
6,153,293 A 11/2000 Dahl et al.
6,161,353 A 12/2000 Negola et al.
6,180,211 B1 1/2001 Held
6,180,257 B1 1/2001 Brandt et al.
6,207,729 B1 3/2001 Medoff et al.
6,210,616 B1 4/2001 Suwanda
6,210,792 B1 4/2001 Seethamraju et al.
D442,701 S 5/2001 Cantley
6,248,813 B1 6/2001 Zehner
6,265,037 B1 7/2001 Godavarti et al.
6,272,808 B1 8/2001 Groh et al.
6,280,667 B1 8/2001 Koenig et al.
6,284,098 B1 9/2001 Jacobsen
6,286,284 B2 9/2001 Cantley
6,295,777 B1 10/2001 Hunter et al.
6,295,778 B1 10/2001 Burt
6,308,487 B1 10/2001 Cantley
6,337,138 B1 1/2002 Zehner et al.
6,341,458 B1 1/2002 Burt
6,342,172 B1 1/2002 Finley
6,344,268 B1 2/2002 Stucky et al.
6,344,504 B1 2/2002 Zehner et al.
6,346,160 B1 2/2002 Puppin
6,357,197 B1 3/2002 Serino et al.
6,358,585 B1 3/2002 Wolff
6,360,508 B1 3/2002 Pelfrey et al.
6,362,252 B1 3/2002 Prutkin
6,409,952 B1 6/2002 Hacker et al.
6,423,257 B1 7/2002 Stobart et al.
6,448,307 B1 9/2002 Medoff et al.
6,453,630 B1 9/2002 Buhrts et al.
6,464,913 B1 10/2002 Korney, Jr.
6,470,643 B1 10/2002 Cantley
6,498,205 B1 12/2002 Zehner
6,511,757 B1 1/2003 Brandt et al.
D470,600 S 2/2003 Cantley
6,531,010 B2 3/2003 Puppin
6,569,540 B1 5/2003 Preston et al.
6,578,368 B1 6/2003 Brandt et al.
6,579,605 B2 6/2003 Zehner
6,590,004 B1 7/2003 Zehner
6,605,245 B1 8/2003 Dubelsten et al.
6,617,376 B2 9/2003 Korney, Jr.
6,632,863 B2 10/2003 Hutchison et al.
6,637,213 B2 10/2003 Hutchison et al.
6,641,384 B2 11/2003 Bosler et al.
6,662,515 B2 12/2003 Buhrts et al.
6,680,090 B2 1/2004 Godavarti et al.
6,682,789 B2 1/2004 Godavarti et al.
6,682,814 B2 1/2004 Hendrickson et al.
6,685,858 B2 2/2004 Korney, Jr.
6,708,504 B2 3/2004 Brandt et al.
6,716,522 B2 4/2004 Matsumoto et al.
6,752,941 B2 6/2004 Hills
6,773,255 B2 8/2004 Benz et al.
6,780,359 B1 8/2004 Zehner et al.
6,784,216 B1 8/2004 Zehner et al.
6,784,230 B1 8/2004 Patterson et al.
6,793,474 B2 9/2004 Gröeblacher et al.
6,844,049 B2 1/2005 Amin-Javaheri
6,863,972 B2 3/2005 Burger et al.
6,939,496 B2 9/2005 Maine et al.
6,958,185 B1 10/2005 Zehner
6,971,211 B1 12/2005 Zehner
6,984,676 B1 1/2006 Brandt
7,017,352 B2 3/2006 Hutchison et al.

| | | | |
|---|---|---|---|
| 7,030,179 | B2 | 4/2006 | Patterson et al. |
| 7,037,865 | B1 | 5/2006 | Kimberly |
| 7,186,457 | B1 | 3/2007 | Zehner et al. |
| 7,378,462 | B1 | 5/2008 | Hughes et al. |
| 7,445,840 | B2 | 11/2008 | Moriya et al. |
| 7,743,567 | B1 | 6/2010 | Buhrts |
| 2001/0019749 | A1 | 9/2001 | Godavarti et al. |
| 2001/0051242 | A1 | 12/2001 | Godavarti et al. |
| 2001/0051243 | A1 | 12/2001 | Godavarti et al. |
| 2002/0015820 | A1 | 2/2002 | Puppin |
| 2002/0038684 | A1 | 4/2002 | Puppin |
| 2002/0040557 | A1 | 4/2002 | Felton |
| 2002/0066248 | A1 | 6/2002 | Buhrts et al. |
| 2002/0090471 | A1 | 7/2002 | Burger et al. |
| 2002/0092256 | A1 | 7/2002 | Hendrickson et al. |
| 2002/0106498 | A1 | 8/2002 | Deaner et al. |
| 2002/0143083 | A1 | 10/2002 | Korney, Jr. |
| 2002/0161072 | A1 | 10/2002 | Jacoby et al. |
| 2002/0166327 | A1 | 11/2002 | Brandt et al. |
| 2002/0174663 | A1 | 11/2002 | Hutchison et al. |
| 2002/0192401 | A1 | 12/2002 | Matsumoto et al. |
| 2002/0192431 | A1 | 12/2002 | Edgman |
| 2003/0021915 | A1 | 1/2003 | Rohatgi et al. |
| 2003/0025233 | A1 | 2/2003 | Korney, Jr. |
| 2003/0050378 | A1 | 3/2003 | Blanchard et al. |
| 2003/0087994 | A1 | 5/2003 | Frechette |
| 2003/0087996 | A1 | 5/2003 | Hutchison et al. |
| 2003/0096094 | A1 | 5/2003 | Hayduke |
| 2003/0154662 | A1 | 8/2003 | Bruchu et al. |
| 2003/0176538 | A1 | 9/2003 | Wu et al. |
| 2003/0229160 | A1 | 12/2003 | Williams et al. |
| 2004/0026021 | A1 | 2/2004 | Groh et al. |
| 2004/0038002 | A1 | 2/2004 | Franco et al. |
| 2004/0048055 | A1 | 3/2004 | Branca |
| 2004/0071964 | A1 | 4/2004 | Nesbitt |
| 2004/0142157 | A1 | 7/2004 | Melkonian |
| 2004/0147625 | A1 | 7/2004 | Dostal et al. |
| 2004/0148965 | A1 | 8/2004 | Hutchison et al. |
| 2004/0191494 | A1 | 9/2004 | Nesbitt |
| 2004/0192794 | A1 | 9/2004 | Patterson et al. |
| 2004/0219357 | A1 | 11/2004 | Van Dijk et al. |
| 2004/0220299 | A1 | 11/2004 | Drabeck, Jr. et al. |
| 2005/0009960 | A1 | 1/2005 | Ton-That et al. |
| 2005/0013984 | A1 | 1/2005 | Dijk et al. |
| 2005/0067729 | A1 | 3/2005 | Laver et al. |
| 2005/0154094 | A1 | 7/2005 | Maeda et al. |
| 2005/0163969 | A1 | 7/2005 | Brown |
| 2005/0171246 | A1 | 8/2005 | Maine et al. |
| 2005/0192382 | A1 | 9/2005 | Maine et al. |
| 2005/0266222 | A1 | 12/2005 | Clark et al. |
| 2005/0271872 | A1 | 12/2005 | Dolinar |
| 2005/0271889 | A1 | 12/2005 | Dolinar |
| 2006/0010883 | A1 | 1/2006 | Hutchison et al. |
| 2006/0010884 | A1 | 1/2006 | Hutchison et al. |
| 2006/0012066 | A1 | 1/2006 | Hutchison et al. |
| 2006/0012071 | A1 | 1/2006 | Groh et al. |
| 2006/0022372 | A1 | 2/2006 | Matuana et al. |
| 2006/0057348 | A1 | 3/2006 | Maine et al. |
| 2006/0068053 | A1 | 3/2006 | Brandt et al. |
| 2006/0068215 | A2 | 3/2006 | Dolinar |
| 2006/0269738 | A1 | 11/2006 | Kimberly |
| 2007/0235705 | A1 | 10/2007 | Burger et al. |
| 2007/0296112 | A1 | 12/2007 | Brandt et al. |
| 2008/0093763 | A1 | 4/2008 | Mancosh et al. |
| 2008/0197523 | A1 | 8/2008 | Heigel et al. |
| 2009/0264560 | A1 | 10/2009 | Warnes et al. |

FOREIGN PATENT DOCUMENTS

| | | | |
|---|---|---|---|
| CH | 580130 | A5 | 9/1976 |
| CL | 343-95 | | 3/1995 |
| CL | 3037-99 | | 12/1999 |
| DE | 2042176 | | 4/1971 |
| DE | 3801574 | A1 | 8/1989 |
| DE | 4033849 | A1 | 4/1991 |
| DE | 4221070 | A1 | 12/1993 |
| DK | 140148 | B | 6/1979 |
| EP | 0269470 | A2 | 1/1988 |
| EP | 0586211 | A1 | 3/1994 |
| EP | 0586212 | A2 | 3/1994 |
| EP | 0586213 | A1 | 3/1994 |
| EP | 0668142 | A1 | 8/1995 |
| EP | 0747419 | A2 | 12/1996 |
| FR | 2270311 | A1 | 12/1975 |
| FR | 2365017 | A1 | 4/1978 |
| FR | 2445885 | A1 | 8/1980 |
| FR | 2564374 | A1 | 11/1985 |
| GB | 1298823 | | 12/1972 |
| GB | 1443194 | | 7/1976 |
| GB | 2036148 | A | 6/1980 |
| GB | 2104903 | A | 3/1983 |
| GB | 2171953 | A | 9/1986 |
| GB | 2186655 | A | 8/1987 |
| JP | 57-190035 | A | 11/1982 |
| JP | 2000-17245 | A | 1/2000 |
| JP | 2000-109589 | A | 4/2000 |
| JP | 2002-86544 | A | 3/2002 |
| JP | 2002-113768 | A | 4/2002 |
| JP | 2002-137333 | A | 5/2002 |
| JP | 2002-144489 | A | 5/2002 |
| WO | 90/08020 | A1 | 7/1990 |
| WO | 95/13179 | A1 | 5/1995 |
| WO | 99/11444 | A1 | 3/1999 |
| WO | 00/11282 | A2 | 3/2000 |
| WO | 00/34017 | A1 | 6/2000 |
| WO | 00/39207 | A1 | 7/2000 |
| WO | 01/66873 | A1 | 9/2001 |
| WO | 02/057692 | A2 | 7/2002 |
| WO | 02/079317 | A1 | 10/2002 |
| WO | 02/103113 | A2 | 12/2002 |
| WO | 03/091642 | A1 | 11/2003 |
| WO | 2004/083541 | A2 | 9/2004 |
| WO | 2004/083541 | A3 | 11/2004 |
| WO | 2004/102092 | A1 | 11/2004 |
| WO | 2006/041508 | A2 | 4/2006 |
| WO | 2006/071517 | A2 | 7/2006 |
| WO | 2007/085836 | A1 | 8/2007 |

OTHER PUBLICATIONS

Stark et al., Effect of Particle Size on Properties of Wood-Flour Reinforced Polypropylene Composites, The Fourth International Conference on Woodfiber-Plastic Composites, 1997, pp. 134-143.

Stark et al., Photostabilization of Wood Flour Filled HDPE Composites, ANTEC, May 5-9, 2002, pp. 2209-2013.

Stark, Wood Fiber Derived From Scrap Pallets Used in Polypropylene Composites, Forest Products Journal, vol. 49, No. 6, Jun. 1999, pp. 39-46.

Suchsland et al., Fiberboard Manufacturing Practices in the United States, Agriculture Handbook No. 640, United States Department of Agriculture Forest Service, 1986, 4 pages.

Thomas et al., Wood Fibers for Reinforcing Fillers for Polyolefins, ANTEC, 1984, pp. 687-689.

Wood Filled PVC, Plastics Industry News, Jul. 1996, p. 6.

Woodhams et al., Wood Fibers for Reinforcing Fillers for Polyolefins, Polymer Engineering and Science, Oct. 1984, pp. 1166-1171.

Yam et al., Composites from Compounding Wood Fibers With Recycled High Density Polyethylene, Polymer Engineering and Science, mid-Jun. 1990, pp. 693-699, vol. 30, No. 11.

Yuskova et al., Interaction of Components in Poly(Vinyl Chloride) Filled in Polymerization, Makroniol Chem., Macromol. Symp. 29, 315-320 (1989).

Zadorecki et al., Future Prospects for Wood Cellulose as Reinforcement in Organic Polymer Composites, Polymer Composites, Apr. 1989, pp. 69-77.

ASTM, Standard Terminology Relating to Wood-Base Fiber and Particle Panel Material, 1995 Annual Book of ASTM Standards, vol. 04.10, Oct. 1986, pp. 214-216.

Bendtsen et al., Chapter 4: Mechanical Properties of Wood, USDA Ag. Hdbk. #72, Wood Handbook: Wood as an Engineering Material, Madison, WI, pp. 4-2 to 4-44 (1987).

Bibliography of Solid Phase Extrusion, pp. 187-195.

Brzoskowski et al., Air-Lubricated Die for Extrusion of Rubber Compounds, Rubber Chemistry and Technology, vol. 60, p. 945-956 (1987).

Campbell et al., The Reinforcement of Thermoplastic Elastomers With Santoweb® Fibre, Short Fibre Reinforced Thermoplastics, pp. 14/1-14/10.
Collier et al., High Strength Extrudates by Melt Transformation Coextrusion, ANTEC, 1987, pp. 497-502.
Collier et al., Streamlined Dies and Profile Extrusion, ANTEC, 1987, pp. 203-206.
Company News, Plastics Industry News, May 1994, pp. 70-71.
Dalvag et al., The Efficiency of Cellulosic Fillers in Common Thermoplastics. Part II. Filling with Processing Aids and Coupling Agents, 1985, vol. 11, pp. 9-38.
Doroudiani et al., Structure and Mechanical Properties Study of Foamed Wood Fiber/Polyethylene Composites, ANTEC, 1997, pp. 2046-2050.
EIN Engineering Inc., Making Wood From Waste Wood and Waste Plastic Using EIN Technology, EIN Plastic & Wood Recycling System Catalog, 1999, 16 pages.
EIN Engineering Inc., Wood-like Material Superior to Real Wood, 5 pages.
English et al., Wastewood-Derived Fillers for Plastics, The Fourth International Conference on Woodfiber-Plastic Composites, 1997, pp. 309-324.
Fiberloc Polymer Composites, B.F. Goodrich, Geon Vinyl Division, section 1, pp. 2-15 (1986).
Fill Thermoplastics with Wood, Modern Plastics, May 1974, pp. 54-55.
Fillers for Thermoplastics: Beyond Resin Stretching, Modern Plastics International, Oct. 1976, pp. 12-15.
From Sweden: Extruded Interior Trim Made of PVC and Wood Fluor, Plastic Building Construction, vol. 9 No. 5, 1986, pp. 5-6.
Forest Products Laboratory, Wood Handbook: Wood as an Engineering Material, Agriculture Handbook 72, United States Department of Agriculture Forest Service, 1974, 2 pages.
Gatenholm et al., The Effect of Chemical Composition of Interphase on Dispersion of Cellulose Fibers in Polymers. I. PVC-Coated Cellulose in Polystyrene, Journal of Applied Polymer Science, vol. 49, 1993, pp. 197-208.
Henrici-Olive et al., Integral/Structural Polymer Foams: Technology, Properties and Applications, Springer-Verlag, pp. 111-122 (1986).
Klason et al., The Efficiency of Cellulosic Fillers in Common Thermoplastics. Part 1. Filling without Processing Aids or Coupling Agents, Polymeric Materials, 1984, vol. 10, pp. 159-187.
Kokta et al., Composites of Poly(Vinyl Chloride) and Wood Fibers. Part II: Effect of Chemical Treatment, Polymer Composites, Apr. 1990, pp. 84-89.
Kokta et al., Composites of Polyvinyl Chloride—Wood Fibers. I. Effect of Isocyanate as a Bonding Agent, Polym.-Plast. Technol. Eng., 1990, 29(1&2), pp. 87-118.
Kokta et al., Composites of Polyvinyl Chloride—Wood Fibers. III: Effect of Silane as Coupling Agent, Journal of Vinyl Technology, Sep. 1990, pp. 146-153.
Kokta et al., "Use of Grafted Wood Fibers in Thermoplastic Composites v. Polystyrene", Centre de recherche en pâtes et papiers, Université du Québec à Trois-Rivières, Canada (1986).
Kokta et al., Use of Wood Fibers in Thermoplastic Composites, Polymer Composites, Oct. 1983, pp. 229-232.
Kowalska et al., Modification of Recyclates of Polyethylene and Poly(Vinyl Chloride) with Scrap Paper Cellulose Fibres, Polymer Recycling, vol. 6, Nos. 2/3, 2001, pp. 109-118.
Lightsey, Organic Fillers for Thermoplastics, Polymer Science and Technology, vol. 17, Aug. 1981, pp. 193-211.
Maldas et al., Composites of Polyvinyl Chloride—Wood Fibers: IV. Effect of the Nature of Fibers, Journal of Vinyl Technology, Jun. 1989, pp. 90-98.
Maldas et al., Improving Adhesion of Wood Fiber with Polystyrene by the Chemical Treatment of Fiber with a Coupling Agent and the Influence on the Mechanical Properties of Composites, Journal of Adhesion Science Technology, vol. 3 No. 7, pp. 529-539 (1989).
Maloney, Modern Particleboard & Dry-Process Fiberboard Manufacturing, Miller Freeman Publications, 1977, 6 pages.
Myers et al., "Wood flour and polypropylene or high-density polyethylene composites: influence of maleated polypropylene concentration and extrusion temperature on properties", Forest Products Society, Wood Fiber/Polymer Composites: Fundamental Concepts, Processes, and Material Options, Madison, WI, pp. 49-56 (1993).
Myers et al., Bibliography: Composites from Plastics and Wood-Based Fillers, USDA Forest Products Laboratory, Madison, WI, pp. 1-27 odds (1991).
Myers et al., Effects of Composition and Polypropylene Melt Flow on Polypropylene—Waste Newspaper Composites, ANTEC, 1992, pp. 602-604.
Panshin et al., Forest Products, Wood Flour, Chapter 11, 1950, pp. 232-239.
Pornnimit et al., Extrusion of Self-Reinforced Polyethylene, Advances in Polymer Technology, vol. 11, No. 2, pp. 92-98 (1992).
Raj et al., The Influence of Coupling Agents on Mechanical Properties of Composites Containing Cellulose Fillers, Marcel Dekker, Inc., 1990, pp. 339-353.
Raj et al., Use of Wood Fiber as Filler in Common Thermoplastics: Studies on Mechanical Properties, Science and Engineering of Composite Materials, vol. 1 No. 3, 1989, pp. 85-98.
Raj et al., Use of Wood Fibers in Thermoplastics. VII. The Effect of Coupling Agents in Polyethylene—Wood Fiber Composites, Journal of Applied Polymer Science, vol. 37, pp. 1089-1103 (1989).
Redbook, For Resin Producers, Formulators, and Compounders, Plastics Compounding, 1992/93, 2 pages.
Reineke, Wood Flour, U.S. Department of Agriculture Forest Service, U.S. Forest Service Research Note FPL-0113, Jan. 1966, 7 pages.
Resin Stretching: Accent on Performance, Modern Plastic International, Jan. 1974, pp. 58-60.
Robson et al., A Comparison of Wood and Plant Fiber Properties, Proceedings: Woodfiber-Plastic Composites, 1995, pp. 41-46.
Rogalski et al., Poly(Vinyl-Chloride) Wood Fiber Composites, ANTEC, 1987, pp. 1436-1441.
Royal Group Technologies, Inc., New Composite Building Material Adds the Right Mix of Beauty and Brawn to Upscale Homes, www.royalgrouptech.com, printed Aug. 18, 2005, 3 pages.
Schneider et al., Biofibers as Reinforcing Fillers in Thermoplastic Composites, ANTEC, 1994, pp. 6 pages.
Schut, Compatibilizing Mixed Post-Consumer Plastics, Plastics Formulating & Compounding, Mar./Apr. 1997, pp. 43.
Simonsen et al., Wood-Fiber Reinforcement of Styrene-Maleic Anhydride Copolymers, J. Appl. Polm. Sci. 68, No. 10, Jun. 6, 1998, pp. 1567-1573.
Sonwood Outline, Sonesson Plast AB, Apr. 1975.
Sonwood: a new PVC wood-flour alloy for Extrusions and other Plastic Processing Techniques, Sonesson Plast AB, Malmo, Sweden (1975).
Universal Forest Products, Inc., Wood Lattice, http://web.archive.org/web/20030811043510/http://www.ufpi.com/PRODUCT/wlattice/index.htm, 1 page, Aug. 11, 2003.

* cited by examiner

METHODS OF MANUFACTURING A LATTICE HAVING A DISTRESSED APPEARANCE

This application is a continuation-in-part of U.S. application Ser. No. 10/995,086, filed Nov. 22, 2004 now abandoned. The entirety of this application is hereby incorporated by reference.

BACKGROUND AND SUMMARY OF THE INVENTION

Exemplary embodiments of the present invention relate generally to composite products. More particularly, exemplary embodiment of the present invention are directed to methods of manufacturing a lattice structure made from composite materials such as cellulosic-filled and/or inorganic-filled plastic composite materials. The composite lattice may be used as gates, fences, porch and deck skirts, and other similar structures. For example, an exemplary composite lattice of the present invention may be used as a privacy barrier or as an ornamental skirting or façade such as the skirting around the bottom of an elevated deck or porch built off the back of a home.

Generally, lattice structures such as deck skirts are made from wood. The use of wood products in outdoor applications can cause a multitude of problems. First, the wood needs to be pre-treated for protection against weather, thus increasing the cost of the lumber used to construct the lattice. Although the wood lattice is pretreated, extended exposure to the weather causes the wood to warp, crack, splinter, and generally deteriorate in condition. To aid in slowing the effects of this exposure, the wood requires yearly maintenance. Typically, this comprises pressure washing or sanding the wood and then re-painting or staining it. Since this is quite a time-consuming process, many fail to perform this necessary annual maintenance, thus increasing the deterioration of the lattice structure.

Some have tried to overcome the problems of using wood by making lattice structures from plastic materials such as vinyl. However, the prior art has failed to address methods of producing lattice structures using more recently developed wood composites.

For example, U.S. Pat. No. 6,286,284 by Cantley is a utility patent that teaches the manufacture of a one-piece molded plastic lattice that simulates a lattice of separate superposed members. The lattice is manufactured with injection molding, but neither discloses the use of a wood composite materials nor methods of manufacturing a lattice using wood composites.

An exemplary embodiment of the present invention may satisfy some or all of these needs. One exemplary embodiment of the present invention is a method of manufacturing a lattice structure comprised of a composite material. In particular, the lattice structure may be made from cellulosic-filled or inorganic-filled plastic composites. As compared to natural woods, a cellulosic composite may offer superior resistance to wear and tear and to degradation caused by adverse weathering effects, and may also reduce overall maintenance costs. For instance, a cellulosic composite may have an enhanced resistance to moisture. In fact, it is well known that the retention of moisture is a primary cause of the warping, splintering, and discoloration of natural woods as described above. Moreover, a cellulosic composite may be sawed, sanded, shaped, turned, fastened, and finished in a similar manner as natural woods.

In an exemplary embodiment, a component of a lattice may be of any desired type, shape, and dimension. Manufacturing processes, for example, include but are not limited to, injection molding, compression molding, extrusion, and structural molding. Secondary operations, such as stamping or brushing may be optionally employed to impart the desired appearance on the lattice. Inclusion of mechanical attachment means may also be embodied to facilitate assembly of the lattice if the structure is optionally fabricated as a piece-part construction.

Other types of articles that may benefit from exemplary embodiments of the present invention include other types of various lattice structures including, but not limited to, ornamental gardening trellises, overhead outdoor patio or deck coverings, window lattices, privacy fences, garden fences, and other suitable indoor and outdoor items.

In addition to the novel features and advantages mentioned above, other features and advantages will be readily apparent from the following descriptions of the drawings and exemplary embodiments.

DETAILED DESCRIPTION OF EXEMPLARY EMBODIMENT(S)

Figure 1:
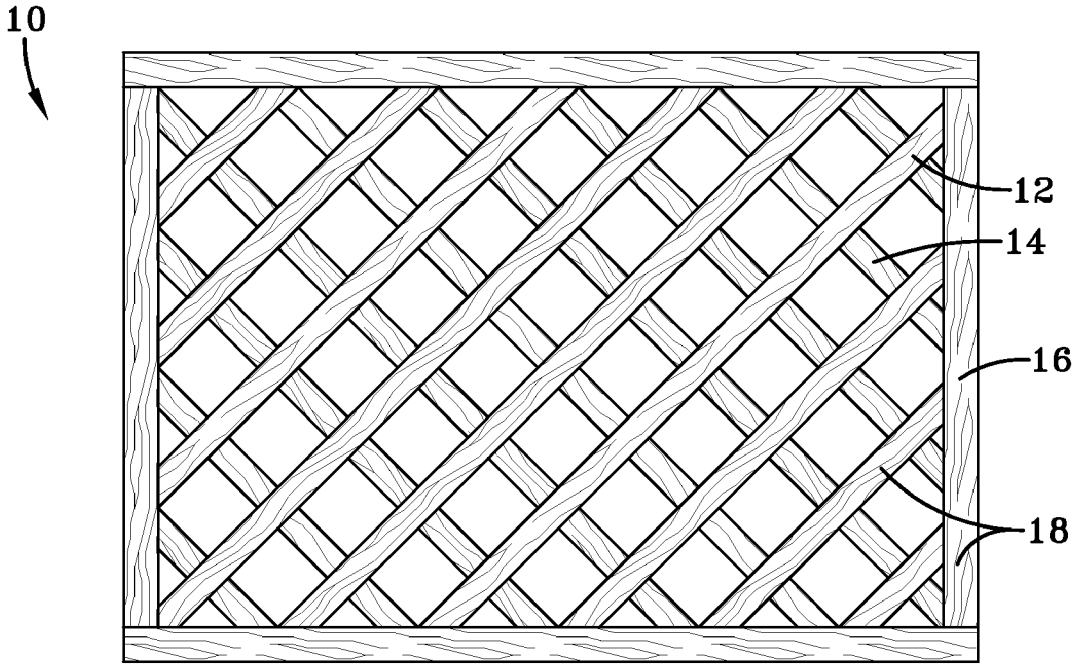
FIG. 1 shows a front elevation view of an exemplary embodiment of a component of the present invention structure as with all slats of the same orientation on the same sides of the intersecting lattice slats.

Referring to the drawings, exemplary embodiments of the present invention are directed to the manufacture of a composite lattice product. More particularly, exemplary embodiments of the present invention are directed to the manufacture of a lattice structure made from cellulosic-filled and/or inorganic-filled plastic composites. The composite lattice may be used, for example, as a privacy barrier or as an ornamental skirting or facade.

Lattice, as used herein, is defined as a framework of crossed strips. Typically, a lattice forms a regular or other desired geometrical arrangement. Nevertheless, other variations may be possible. For purposes of further illustration, and not limitation, a lattice may be used as a decorative skirting around decks that are built above the ground and around homes or other structures. Another example of lattice structures can be seen on the top of fences, providing both ornamental feature as well as additional privacy.

Exemplary embodiments of the present invention provide methods of manufacturing a lattice structure that may be made from a cellulosic-filled and/or inorganic-filled composite. This composite may be comprised of materials that include, but are not limited to, cellulosic fillers, polymers, inorganic fillers, cross-linking agents, lubricants, process aids, stabilizers, accelerators, inhibitors, enhancers, compatibilizers, blowing agents, foaming agents, thermosetting materials, pigments, anti-oxidants, and other suitable materials. Examples of cellulosic fillers include sawdust, newspapers, alfalfa, wheat pulp, wood chips, wood fibers, wood particles, ground wood, wood flour, wood flakes, wood veneers, wood laminates, paper, cardboard, straw, cotton, rice hulls, coconut shells, peanut shells, bagass, plant fibers, bamboo fiber, palm fiber, kenaf, flax, and other similar materials. Examples of polymers include multilayer films, high density polyethylene (HDPE), low density polyethylene (LDPE), chlorinated polyethylene (CPE), polypropylene (PP), polyvinyl chloride (PVC), chlorinated polyvinyl chloride (CPVC), acrylonitrile butadiene styrene (ABS), ethyl-vinyl acetate (EVA), other similar copolymers, other similar, suitable, or conventional thermoplastic materials, and formulations that incorporate any of the aforementioned polymers. Examples of inorganic fillers include talc, calcium carbonate, kaolin clay, magnesium oxide, titanium dioxide, silica, mica, barium sulfate, and other similar, suitable, or conventional materials. Examples of cross-linking agents include polyurethanes, such as isocyanates, phenolic resins, unsaturated polyesters, epoxy resins, maleic anhydride, and other similar, suitable, or conventional materials. Combinations of the aforementioned materials are also examples of cross-linking agents. Examples of lubricants include zinc stearate, calcium stearate, esters, amide wax, paraffin wax, ethylene bis-stearamide, and other similar, suitable, or conventional materials. Examples of stabilizers include light stabilizers, tin stabilizers, lead and metal soaps such as barium, cadmium, and zinc, and other similar, suitable, or conventional materials. In addition, examples of process aids include acrylic modifiers and other similar, suitable, or conventional materials. Examples of pigments include titanium dioxide and other similar or suitable additives.

A compositional range of one exemplary cellulosic composite is comprised of cellulosic material in an amount of about 25% to about 50% by weight; polyolefin in an amount of about 25% to about 40% by weight; lubricant in an amount of about 1% to 10% by weight; inorganic filler in an amount of about 5% to 25% by weight; and color additive in an amount of about 1% to about 15% by weight of said composite.

An example of embodied color compositions include, but are not limited to: color additives in an amount of about 70% to about 90% by weight of said color additive; anti-oxidant in an amount up to about 10% by weight of said color additive; light stabilizer in an amount up to about 10% by weight of said color additive; and binder in an amount up to about 20% by weight of said color additive.

A compositional range of another exemplary cellulosic composite is comprised of cellulosic material in an amount of about 25% to about 50% by weight; polyolefin in an amount of about 25% to about 70% by weight; and a color pigment in an amount of at least about 4% by weight respectively of said composite.

A further example of a lattice structure composite comprises about 20% to about 55% by weight cellulosic material; polymer from about 20% to 40% by weight; lubricant up to about 15% by weight; inorganic filler in an amount up to about 20% by weight; anti-oxidant in an amount of about 0% to about 0.75% by weight; light stabilizer in an amount of 0% to about 0.75% by weight; and binder in an amount of about 0% to about 1.5% by weight of said composite.

A specific example of a cellulosic composite is comprised of the following ingredients:

| Ingredient | Approximate Amount by Weight |
|---|---|
| Wood Flour | 41% |
| HDPE | 32% |
| Lubricant | 5% |
| Inorganic Filler | 13% |
| Color Additive | 8% |

In an exemplary method of making a product of the present invention from a cellulosic composite, the cellulosic filler(s) may be dried to a desired moisture content. For example, the cellulosic filler(s) may be dried to about 0.5% to about 3% moisture content by weight, more preferably to about 1% to about 2% moisture content by weight. However, it is appreciated that the cellulosic filler(s) may have a moisture content less than about 0.5% by weight or greater than about 3% by weight. In addition, it should be recognized that an in-line compounding and extrusion system may be utilized to eliminate a pre-drying step. Some or all of the composite ingredients may be combined in a mixer prior to introduction into a molding apparatus such as, for example, an injection molding apparatus, a compression molding apparatus, an extruder (which may include a die system), or a structural molding apparatus, or any other similar or suitable apparatus. Also, some or all of the ingredients may be separately introduced into the selected apparatus. One example of a mixer is a high intensity mixer such as those made by Littleford Day Inc. or Henschel Mixers America Inc. Another type of a mixer is a low intensity mixer including, but not limited to, a ribbon blender. The type of mixer may be selected to blend the ingredients at desired temperatures.

Various methods of manufacturing the described lattice from wood composites, for example, include, but are not limited to, such processes as injection molding, compression molding, extrusion, and structural molding. In an example of injection molding, the composite material is injected into molds which embody the size and shape of the desired final component. In an example of manufacturing a lattice structure using compression molding, a heated preform of composite material is placed in between a set of heated molding dies which have cavities that are machined to the final shape of the desired lattice product. The dies are closed applying the requisite molding pressure on the preform causing the composite material to flow and fill the die cavity, thereby replicating the desired shape of the lattice product. The die is subsequently opened after a prescribed molding period and the part is removed and cooled. One advantage of using a compression molding approach is that a complete part is produced usually requiring no post molding assembly. In an example of producing the desired lattice structure using an extrusion process, an extruder is employed which typically consists of a conical, twin screw, counter-rotating extruder material driving screw with a vent. At least one force feed hopper, crammer, or any other suitable, similar, or conventional apparatus may be used to feed the materials into the extruder. The composite material may be extruded through at least one die. The die system may include a fold-up die, a calibrator, a sizer, or any other similar or suitable equipment for making extruded products. After exiting the die system, the extruded product may be cooled. Similar to the injection molding process, the structural molding process may, for example, employ foaming agents and gas counter-pressure techniques to promote desirable density and physical performance characteristics in the produced lattice structure.

It should be further noted that the lattice structure described herein may be produced, for example, as a single contiguous structure of any desired size as limited only by the limitations of the chosen molding system. Furthermore, in other exemplary embodiments, components of the lattice structure such as, but not limited to, stringers, top and bottom moldings, borders, cross-members, and/or other components may be individually produced as piece-parts for subsequent assembly into a final lattice structural assembly. In the extrusion method of latticework manufacture, for example, each lattice rib component may be extruded, cooled, and cut to desired length for subsequent assembly using a means such as bonding, welding, or use of mechanical fasteners, as examples. Unlike compression molding systems, which use fixed geometry dies, an advantage of using an extrusion molding system or similar manufacturing process lies in its flexibility to produce a wide variety of final product dimensions simply by choosing to cut preassembled parts to the desired range of lengths appropriate to a specific product design.

The surface(s) of the molded or extruded product may optionally be subjected to one or more finishing steps, such as embossing, stamping, or brushing before or after cooling. In one exemplary method, a roller wheel line may be used to impart the embossed pattern(s) on the surface(s) of the product after it has exited the extrusion die system. The roller wheel line may employ a metal wire brush or other suitable distressing means for imparting the pattern. To add desired aesthetic features, the molding apparatus (e.g., a die) may be used to give the product at least one embossed surface. Alternatively, embossing may occur shortly after molding or days later. Furthermore, the introduction of a means of mechanically assembling individual lattice components, such as fasteners and/or adhesives as examples, may be optionally performed in the molding process step, during the finishing step, or both as is applicable to the particular lattice structure desired. Nevertheless, in some exemplary embodiments, the fastening means may be employed at the installation site for the lattice.

Although particular embossing devices have been described herein, it should be recognized that any devices that are suitable for imparting the desired pattern or patterns may be used. Brushing devices may also be used to distress the surfaces of the lattice structure to promote the desired visual effects. Stamping may also be used to impart a distressed wood-grain finish to molded or extruded lattice structural lattice components.

In reference to the drawings, FIG. 1 shows an exemplary embodiment of a manufactured component of the present invention. The component 10 is a lattice structure comprised of lattice slats or strips 12 and 14 arranged orthogonally or approximately orthogonal to each other to form an open mesh. Although any component shape, lattice spacing, and orientation may be produced in concert with the appropriate manufacturing method selected, one exemplary embodiment is of a rectangular shape with the lattice slats oriented at a 45-degree angle relative an optional framing border 16, with all slats of the same orientation positioned on the same sides of the orthogonally oriented lattice slats, as shown in FIG. 1.

The length and width and thickness of the structure can be of any dimension consistent with the chosen manufacturing method. In this exemplary embodiment, the lattice slats have one-sided brushed surfaces 18 to simulate the appearance of wood grain, while their opposite sides may be featureless. Optionally, the opposite side of the lattice slats may have the same surface texture or a different surface texture from its opposite side allowing a user to choose the desired aesthetic effect by exposing the desired surface during installation.

Figure 2:
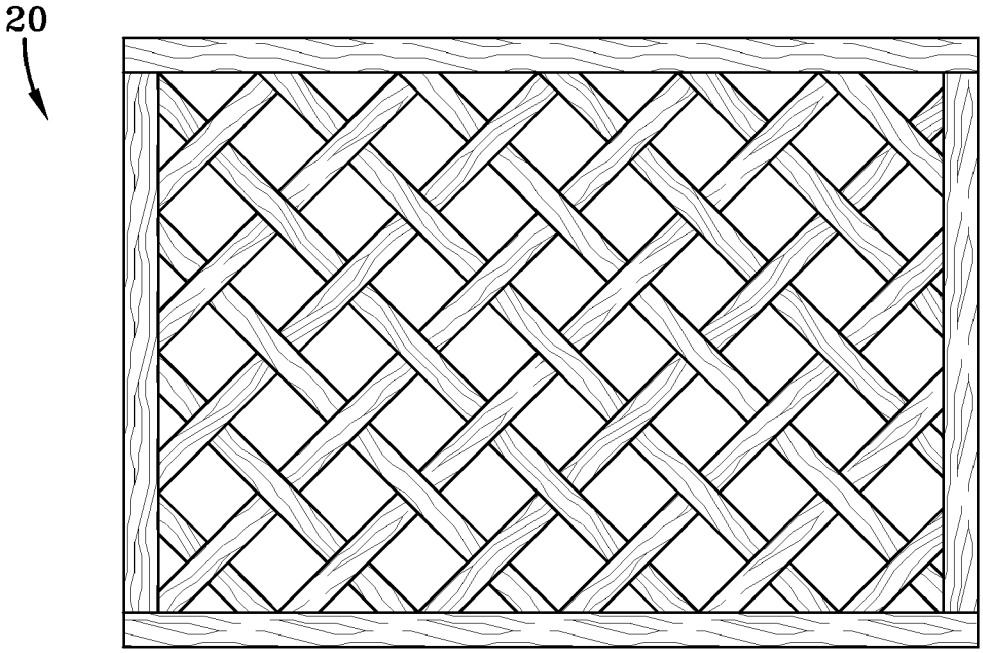
FIG. 2 shows a front elevation view of an exemplary embodiment of a component of the present invention with an interlacing lattice weave pattern such that similarly oriented adjacent lattice slats alternatively pass over and under intersecting slats to form a sandwiched mesh.

Depending on the selected method of manufacture, FIG. 2 illustrates a different option of a component 20, wherein an interlacing lattice weave pattern may be fabricated such that similarly oriented adjacent lattice slats alternatively pass over and under intersecting slats to form a sandwiched mesh structure.

Figure 5:
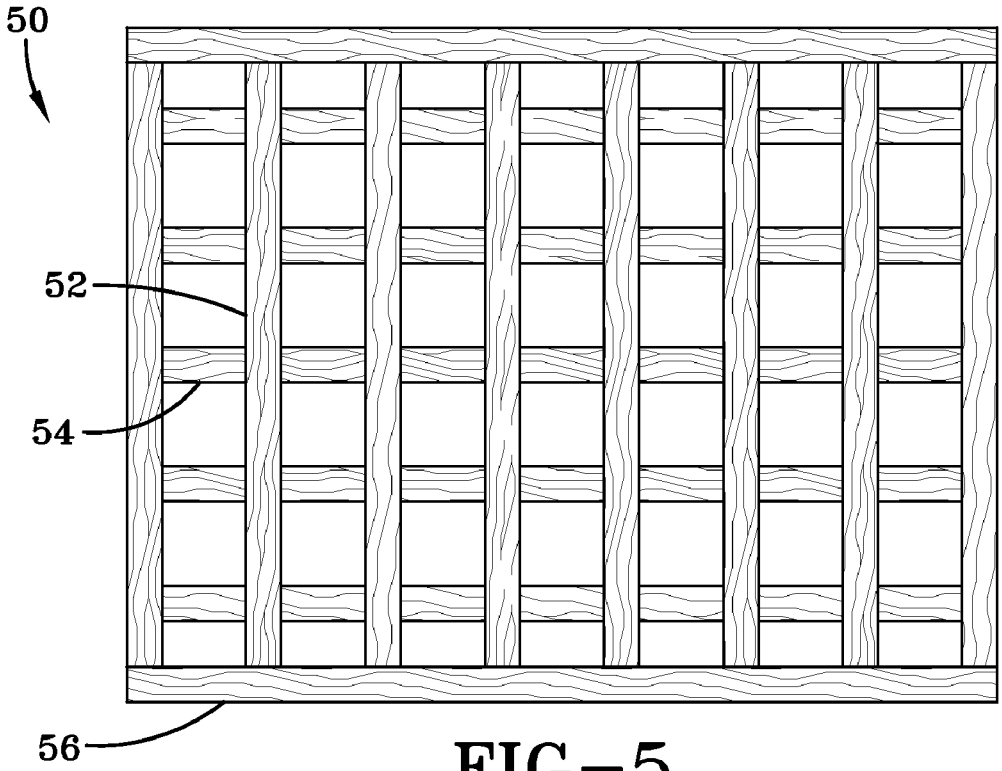
FIG. 5 shows a front elevation view of an exemplary embodiment of a lattice of the present invention.
Figure 6:
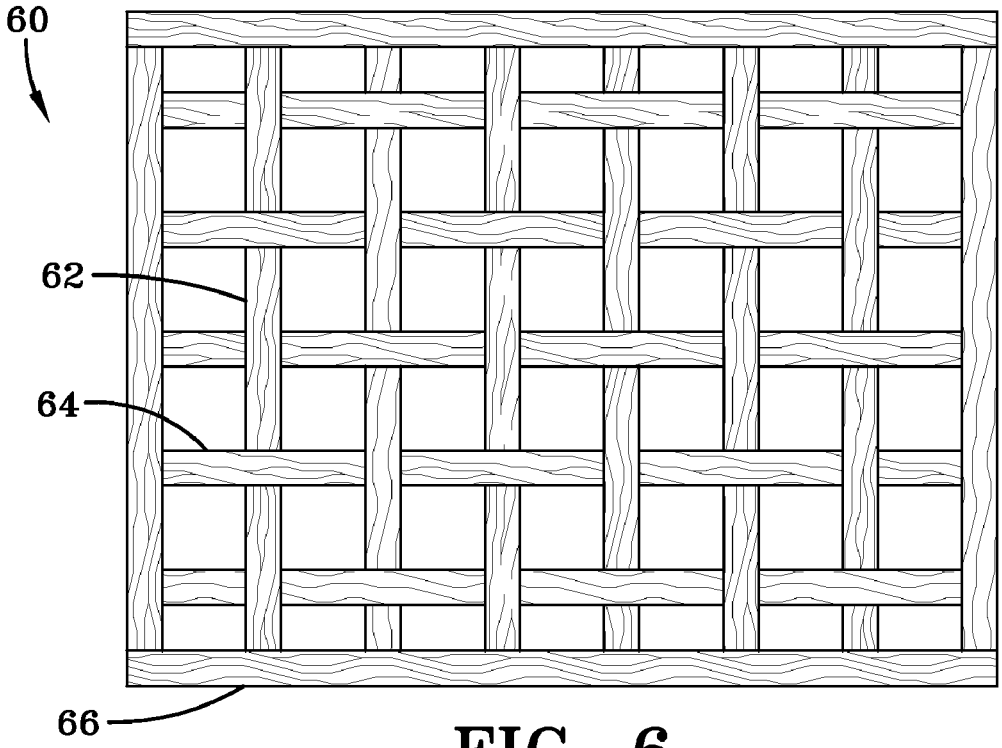
FIG. 6 shows a front elevation view of an exemplary embodiment of a lattice of the present invention.

Other variations are possible. For example, FIG. 5 shows an example of a lattice 50 in which slats or strips 52 and 54 are orthogonal or approximately orthogonal to frame 56. In addition, FIG. 6 shows another example of a lattice 60 in which slats or strips 62 and 64 are orthogonal or approximately orthogonal to frame 66.

Figure 3:
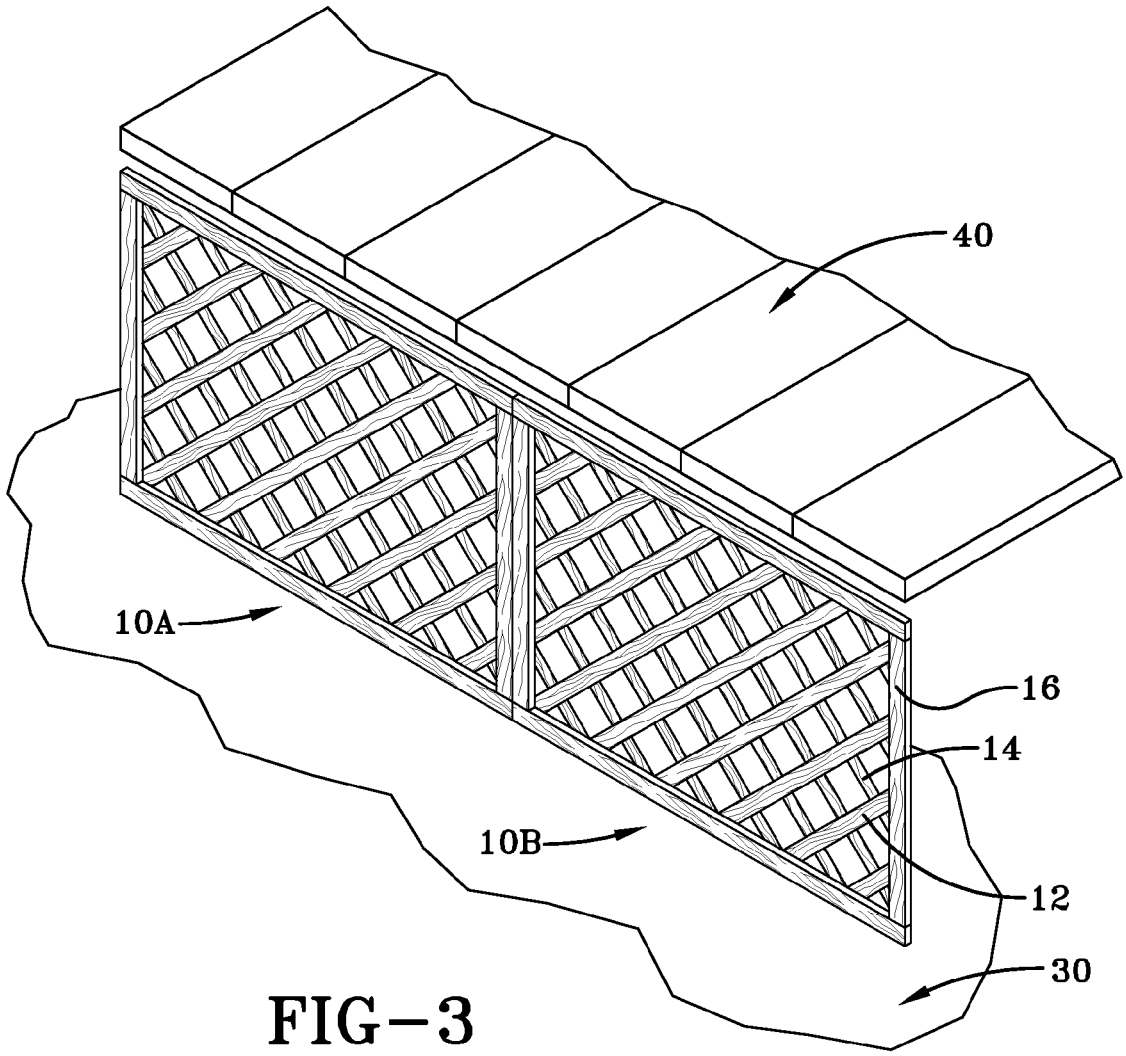
FIG. 3 shows a perspective view of an exemplary embodiment of two components of the present invention for use in a deck skirt application.

An example of an application of an exemplary embodiment is illustrated in FIG. 3, wherein lattice components 10A and 10B are adjacently assembled on ground level 30 as an ornamental skirt around an elevated deck 40. A multiplicity of such lattice components may be adjacently assembled to cover exposed areas of any dimension as desired.

Figure 4:
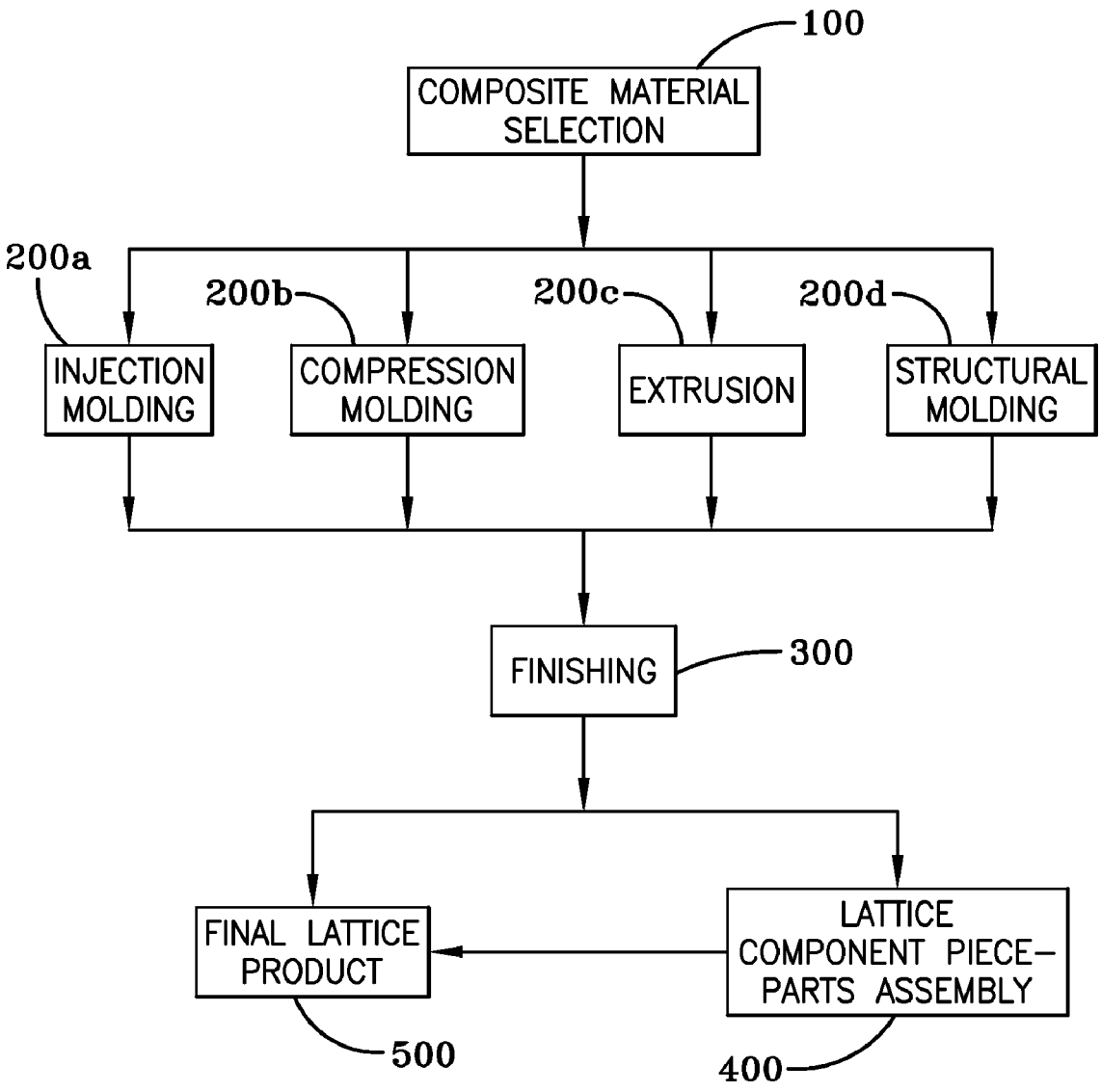
FIG. 4 illustrates exemplary steps in the manufacture of exemplary lattice components.

Referring now to FIG. 4, one exemplary set of processing steps are shown that begin with step 100, which includes selecting the desired lattice composite material. As heretofore described, the lattice structure may be made from a cellulosic-filled and/or inorganic-filled composite. This composite may be comprised of materials that include, but are not limited to, cellulosic fillers, polymers, inorganic fillers, cross-linking agents, lubricants, process aids, stabilizers, accelerators, inhibitors, enhancers, compatibilizers, blowing agents, foaming agents, thermosetting materials, pigments, anti-oxidants, and other suitable materials. Colorants may be selected and included within the composite material composition.

The composite material is next formed, as heretofore described, into the desired lattice structure or structural components by means of the selected molding or extrusion process, such as shown in step 200*a*, 200*b*, 200*c* or 200*d*. Note that the depicted processes are provided as examples and are not intended to limit the selection of another viable process known to those skilled in the art. It should be further noted that texturing schemes may be optionally embodied within the selected process (step 200*a*, 200*b*, 200*c* or 200*d*), for example, by introducing textured surfaces within the molding or extrusion dies.

Next, a finishing process or processes may be optionally applied to the molded or extruded lattice structure or components, as shown in step 300. Optionally, a finishing step may alternatively or additionally occur after assembly in some exemplary embodiments.

If the desired method of fabricating the lattice includes the producing of individual lattice components for subsequent assembly, rather than producing a single-piece lattice structure, assembly of such components may be performed in step 400. Otherwise in the case of a single-piece lattice structure, step 400 may be bypassed and the final lattice product is produced, as shown in step 500, after the optional finishing step 300.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of exemplary embodiments of the present invention so that others skilled in the art may practice the invention. Having shown and described exemplary embodiments of the present invention, those skilled in the art will realize that many variations and modifications may be made to effect the described invention. Many of those variations and modifications will provide the same result and fall within the spirit of the claimed invention. It is the intention, therefore, to limit the invention only as indicated by the scope of the claims.

What is claimed is:

1. A method of manufacturing a lattice, said method comprising the steps of:

a) providing a materials selection step;

b) providing a manufacturing process step; and c) providing a component assembly step comprising mechanically assembling components to form said lattice having a piece-part construction such that said lattice is comprised of a plurality of strips arranged orthogonally to form an open mesh;

wherein said lattice is comprised of a composite material formed from a cellulosic-filled and/or inorganic-filled plastic composite.

2. The method of claim 1 wherein said cellulosic-filled and/or inorganic-filled plastic composite is comprised of components including cellulosic fillers, polymers, inorganic fillers, cross-linking agents, lubricants, process aids, stabilizers, accelerators, inhibitors, enhancers, compatibilizers, blowing agents, foaming agents, thermosetting materials, pigments, anti-oxidants, or other suitable materials or admixtures comprised of at least some of the aforementioned materials.

3. The method of claim 1 wherein said manufacturing process is accomplished by injection molding.

4. The method of claim 1 wherein said manufacturing process is accomplished by compression molding.

5. The method of claim 1 wherein said manufacturing process is accomplished by extrusion.

6. The method of claim 1 wherein said manufacturing process is accomplished by structural molding.

7. The method of claim 1 wherein said lattice has a textured surface.

8. The method of claim 7 wherein said textured surface is produced by embossing.

9. The method of claim 7 wherein said textured surface is produced by brushing.

10. The method of claim 7 wherein said textured surface is produced by stamping.

11. The method of claim 1 wherein said lattice is processed with a finishing step.

* * * * *